United States Patent [19]

Harwood

[11] Patent Number: 4,583,464

[45] Date of Patent: Apr. 22, 1986

[54] SUSPENSION ARRANGEMENTS FOR FOUR-WHEELED RAILWAY VEHICLES

[75] Inventor: Neil A. Harwood, Derby, England

[73] Assignee: British Railways Board, England

[21] Appl. No.: 662,797

[22] Filed: Oct. 19, 1984

Related U.S. Application Data

[63] Continuation of Ser. No. 377,794, May 13, 1982, abandoned.

[30] Foreign Application Priority Data

Apr. 1, 1982 [GB] United Kingdom ..... 8209609

[51] Int. Cl.[4] ..... B61F 5/02; B61F 5/38

[52] U.S. Cl. ..... 105/171; 105/157 R; 105/199 S; 105/222; 188/381; 280/718

[58] Field of Search ..... 105/157 R, 165, 167–171, 105/177, 197.1, 199 S, 218 R, 222, 223, 224 R, 224 A; 267/3, 7, 9 R, 9 A, 19 R, 40, 54 R, 160; 188/381; 280/718, 686

[56] References Cited

U.S. PATENT DOCUMENTS

| | | | |
|---|---|---|---|
| 2,900,924 | 8/1959 | Furrer et al. | 105/199 S |
| 3,682,102 | 8/1972 | Pocklington et al. | 105/171 |
| 4,339,996 | 7/1982 | Brodeur et al. | 105/171 |

FOREIGN PATENT DOCUMENTS

| | | | |
|---|---|---|---|
| 396075 | 1/1966 | Switzerland | 105/218 R |
| 1212513 | 11/1970 | United Kingdom . | |
| 1232695 | 5/1971 | United Kingdom . | |

*Primary Examiner*—Randolph A. Reese
*Assistant Examiner*—Donald T. Hajec
*Attorney, Agent, or Firm*—Hayes, Davis & Soloway

[57] ABSTRACT

A swing link suspension of a four-wheeled rail vehicle has respective pivotal mountings for permitting relative lateral and longitudinal movements of the wheelsets and vehicle body. Those pivotal mountings permitting longitudinal movement are provided with separately formed linings of a material providing a controlled frictional restraint to the longitudinal movement. Longitudinally extending traction rods incorporating resilience in their lengths are connected between the wheelsets and the vehicle body to provide a resilient yaw restraint on the wheelsets.

4 Claims, 3 Drawing Figures

SUSPENSION ARRANGEMENTS FOR FOUR-WHEELED RAILWAY VEHICLES

Figure 1:
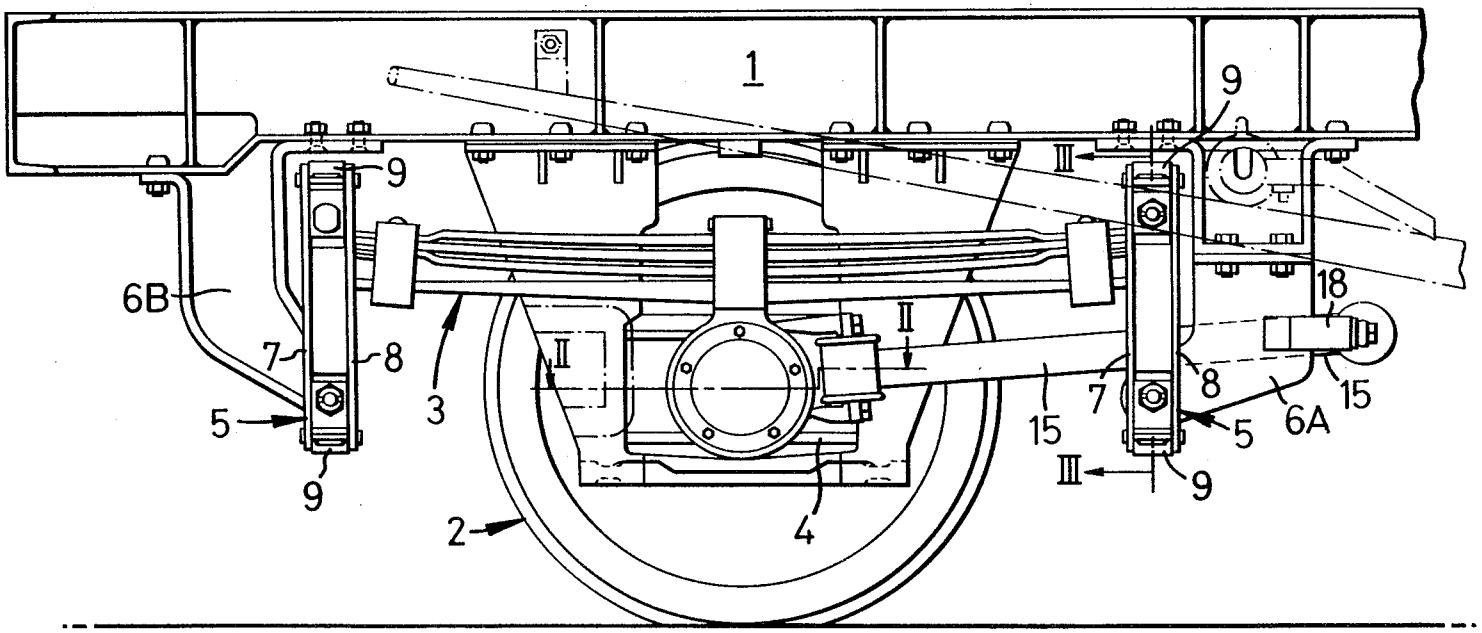

This is a continuation, of application Ser. No. 377,794 filed May 13, 1982, now abandoned.

This invention relates to suspension arrangements of four-wheeled railway vehicles, of the kind having a vehicle body supported on wheelsets through vertical springing, the connection of the body to the wheelsets through the vertical springing including suspension links on which the body is suspended and which are pivotally mounted at their ends so that they can move angularly both laterally and longitudinally to permit relative lateral and longitudinal movements between the wheelsets and the vehicle body.

In British Patent Specification No. 1212513 is described a suspension arrangement of the kind described above and in which separate pivotal mountings are provided for lateral and longitudinal movements and separately formed linings of frictional material are provided in those pivotal mountings which permit lateral movements of the suspension links so as to provide a controlled frictional restraint to relative lateral movements between the vehicle body and wheelsets. Those pivotal mountings which permit longitudinal movements of the suspension links and hence yawing movements of the wheelsets relative to the vehicle body are steel on steel. As axle loads increase, the problem is encountered of the increasing longitudinal friction level inevitable with such steel on steel pivotal mountings producing a degrading effect on body stability and adversely affecting the curving performance of the vehicle.

In British Patent Specification No. 1232695 it was proposed that at least some of those pivotal mountings permitting longitudinal movement of the suspension links incorporate torsionally resilient bushes in order to increase the stiffness at these pivotal mountings and so raise the critical speed at which the onset of wheelset hunting occurs. This arrangement is an impractical one for obviating the aforesaid degrading effect on body stability, firstly because it is impossible to introduce enough rubber into the torsion bushes to give them the required resilient characteristics for practical purposes and secondly, because such bushes would be subject to a severe loading and therefore to a high rate of wear.

The object of the present invention is to provide a satisfactory solution to the aforesaid problem.

According to the present invention in a suspension arrangement of the kind described above the pivotal mountings permitting longitudinal movements of the suspension links are provided with separately formed linings of a material providing a controlled frictional restraint to said longitudinal movement, and longitudinally extending traction rods incorporating resilience in their lengths are connected between the wheelsets and the vehicle body to provide a resilient yaw restraint on the wheelsets.

By providing a controlled frictional restraint to the longitudinal movement of the suspension links and providing resilience in the traction rods and hence separate from the suspension links, the longitudinal frictional damping can be made low and controlled over the whole range of the axle loads and the body/wheelset stability and curving performance can be optimized by adjusting the resilient characteristics of the traction rods.

Figure 2:
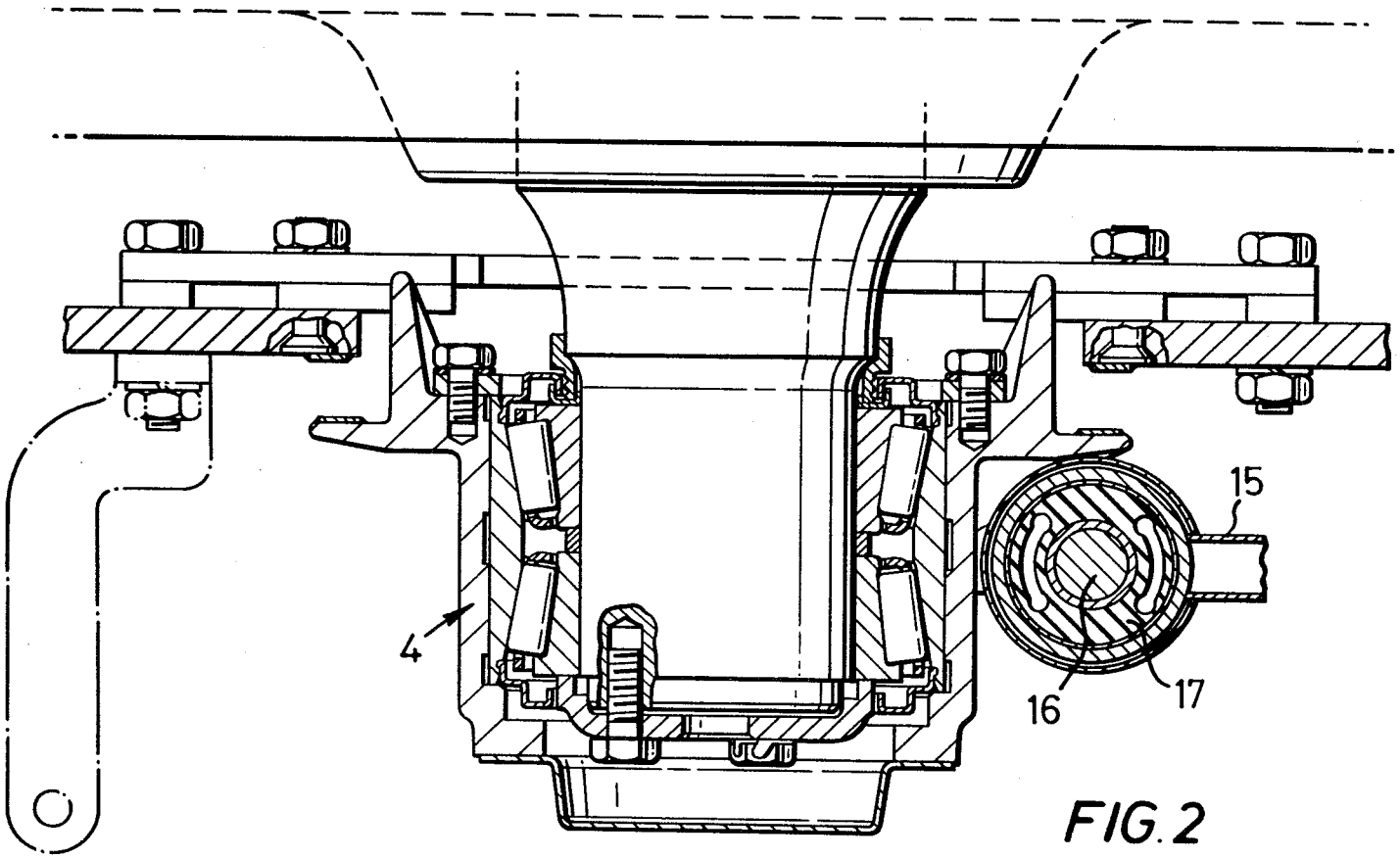
Figure 3:
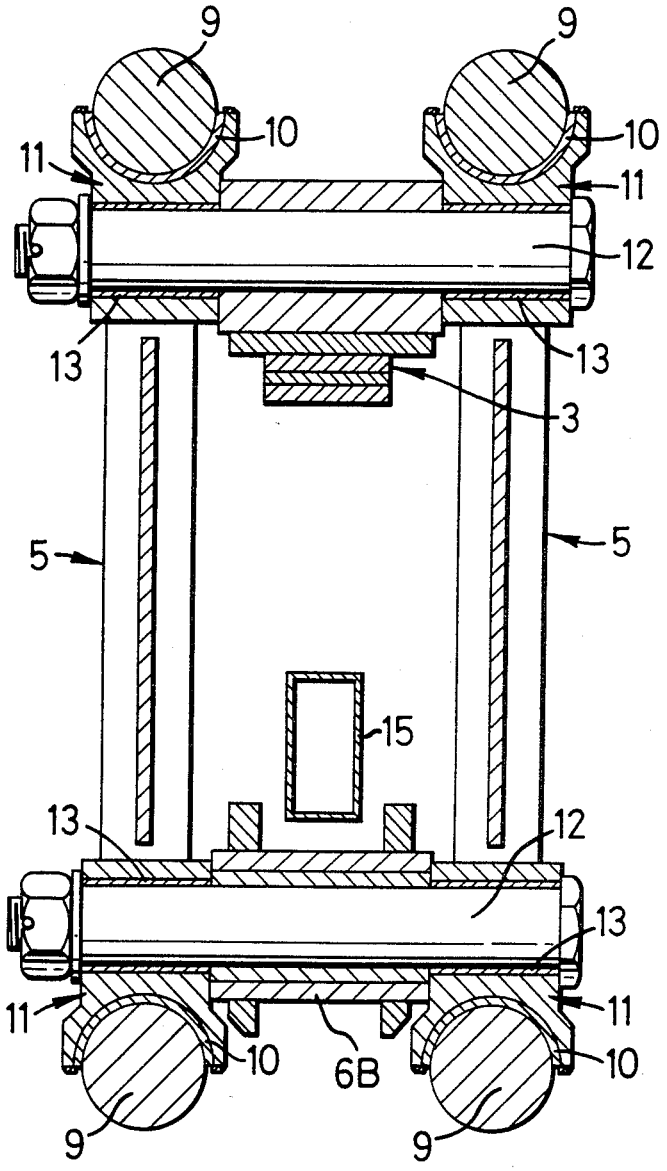

One preferred suspension arrangement in accordance with the invention will now be described by way of example with reference to the accompanying drawings, in which:

FIG. 1 is a side elevational view of the suspension arrangement at one wheelset, FIG. 2 is a sectional view on the line II—II of FIG. 1, and FIG. 3 is a sectional view on the line III—III of FIG. 1.

The body 1 of the vehicle is supported on wheelsets 2 through vertical springing comprising parabolic leaf springs 3 having a two rate characteristic and mounted at their mid-lengths on the axle boxes 4 of the wheelsets 2.

Vertically extending suspension links 5 connect the ends of each leaf spring 3 to suspension brackets 6A and 6B depending from the vehicle body 1, effectively to suspend the body 1 on the leaf springs 3.

The suspension link arrangement at each end of the leaf spring 3 comprises, as best shown in FIG. 3, two parallel suspension links 5 extending one on either side of the leaf spring 3. Each suspension link 5 comprises a pair of limbs 7 and 8 connected to each other at their upper and lower ends by bearing pins 9 which are supported in bearing surfaces 10 (see FIG. 3) of bearing blocks 11 so that the links can swing to permit relative lateral movement between the vehicle body 1 and wheelset 2. The bearing surfaces 10 are provided by separately formed friction linings as described in British Patent Specification No. 1212513.

The bearing blocks 11 are bored at right angles to the bearing surface 10 and receive pins 12 which extend between the two suspension links 5 at each end of each leaf spring 3. At the upper ends of the links 5 the pins 12 pass through the eye of the leaf spring 3 disposed between the two links 5 and so mount the suspension links to the end of the spring 3. A similar mounting arrangement with the suspension brackets 6A or 6B is provided at the lower end of the links 5 through pins 12.

As best seen in FIG. 3, the bores in the bearing blocks 11 for receiving the pins 12 are provided with separately formed liners 13 having a low, controlled coefficient of friction. The properties of the liner material are such that it will provide a lower coefficient of friction than steel on steel and a consistent level on friction in service. The liners 13 can be replaced when worn thus obviating the need to replace the complete bearing block.

A traction rod 15 extends from each axle box 4 and connects as shown with the adjacent suspension bracket 6A on the inboard side of the wheelset 2 or with the suspension bracket 6B on the outboard side of wheelset 2. The traction rod 15, as best seen in FIG. 2, has a pivotal connection with pivot pin 16 on the axle box 4 through a rubber bush 17. At its other end the traction rod 15 has a pivotal connection with a pivot pin (not visible) connected between a pair of supporting brackets 18 extending from the suspension bracket 6A in order to enable the traction rods to have a desired long length.

The resilient characteristics of the rubber bushes 17 are selected so that the traction rods 15 do not interfere significantly with the lateral and vertical movements of the vehicle body 1 relatively to the wheelsets 2 as controlled by the lateral movement of the swing links 5 and the leaf springs 3 respectively. The traction rods 15 are also designed to have the required stiffness or conversely softness to provide the desired yaw constraint between the wheelset and vehicle body for high speed running without incurring wheelset instability, yet allow steering of the wheelsets around curves.

I claim:

1. A suspension arrangement of a four-wheeled railway vehicle having a vehicle body supported on wheelsets through vertical springing, the connection of the body to the wheelsets through the vertical springing including suspension links on which the body is suspended and which have first pivotal mountings at their ends so that they can move laterally to permit lateral movement between the wheelsets and the vehicle body and second pivotal mountings at their ends comprising pivot pins rotating in bores so that the links can move longitudinally, to permit longitudinal movements between the wheelsets and the vehicle body, wherein said bores of the second pivotal mountings are provided with separately formed linings of a friction material providing a predetermined frictional damping to said longitudinal movement, and longitudinally extending traction rods incorporating resilience in their length are connected between the wheelsets and the vehicle body to provide a resilient yaw restraint on the wheelsets.

2. A suspension arrangement according to claim 1, wherein said linings are replaceable.

3. A suspension arrangement according to claim 1, wherein said linings provide a lower coefficient of friction than steel on steel.

4. A suspension arrangement according to claim 1, wherein each said traction rod pivotally connects with the wheelset through a rubber bush providing said resilience.

* * * * *